US009293873B2

(12) United States Patent
Rosenberger

(10) Patent No.: US 9,293,873 B2
(45) Date of Patent: Mar. 22, 2016

(54) CO-AXIAL INSERTION-TYPE CONNECTOR

(75) Inventor: Bernd Rosenberger, Tittmoning (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 43 days.

(21) Appl. No.: 14/122,915

(22) PCT Filed: May 9, 2012

(86) PCT No.: PCT/EP2012/001995

§ 371 (c)(1),
(2), (4) Date: Nov. 27, 2013

(87) PCT Pub. No.: WO2012/167862

PCT Pub. Date: Dec. 13, 2012

(65) Prior Publication Data

US 2014/0134877 A1 May 15, 2014

(30) Foreign Application Priority Data

Jun. 7, 2011 (DE) ..... 10 2011 103 524

(51) Int. Cl.

| | |
|---|---|
| ***H01R 4/50*** | (2006.01) |
| ***H01R 24/38*** | (2011.01) |
| ***H01R 13/645*** | (2006.01) |
| ***H01R 24/40*** | (2011.01) |
| *H01R 9/05* | (2006.01) |
| *H01R 103/00* | (2006.01) |

(52) U.S. Cl.

CPC ..... *H01R 24/38* (2013.01); *H01R 13/6456* (2013.01); *H01R 24/40* (2013.01); *H01R 9/0521* (2013.01); *H01R 2103/00* (2013.01)

(58) Field of Classification Search

CPC ..... H01R 13/625; H01R 13/5208
USPC ..... 439/332, 335, 337, 339, 282, 279, 275, 439/889, 680

See application file for complete search history.

(56) References Cited

U.S. PATENT DOCUMENTS

| | | | | |
|---|---|---|---|---|
| 2,761,110 | A * | 8/1956 | Edlen et al. | 439/581 |
| 3,136,592 | A | 6/1964 | Miller | |
| 6,162,095 | A * | 12/2000 | Holman | 439/607.59 |
| 6,837,754 | B1 | 1/2005 | Walton | |

FOREIGN PATENT DOCUMENTS

| | | | |
|---|---|---|---|
| DE | 1130882 | B | 6/1962 |
| DE | 8424348 | U1 | 11/1984 |
| DE | 4300243 | C1 | 3/1994 |
| DE | 202007017308 | U1 | 2/2008 |

* cited by examiner

*Primary Examiner* — Phuongchi T Nguyen

(74) *Attorney, Agent, or Firm* — DeLio, Peterson & Curcio, LLC; Robert Curcio

(57) ABSTRACT

A coaxial plug-type connector with an outer conductor, an inner conductor, and an insulator connecting the outer conductor and the inner conductor, wherein the outer conductor has an axial contact area for making electrically conductive contact with another coaxial plug-type connector. The axial contact area of the outer conductor is provided with one or more projections.

12 Claims, 3 Drawing Sheets

CO-AXIAL INSERTION-TYPE CONNECTOR

BACKGROUND OF THE INVENTION

1. Field of the Invention

The invention relates to a co-axial insertion-type connector, and in particular to a co-axial insertion-type connector designed in accordance with DIN 47 223, and to a co-axial insertion-type connection formed by two such co-axial insertion-type connectors.

2. Description of Related Art

Standardized under DIN 47 223 is a co-axial insertion-type connector whose center conductor is of an outside diameter of approximately 7 mm and whose outer conductor is of an inside diameter of approximately 16 mm Co-axial insertion-type connectors to DIN 47 223 are therefore also referred to as 7/16 connectors. Because of the specific ratio between the diameters and with air as a dielectric, a characteristic impedance of approximately 50 Ω is obtained between the insertion ends of the center and outer conductors.

A co-axial insertion-type connector designed in accordance with DIN 47 223 in the form of a co-axial plug has, at the insertion end, an end of the center conductor which is in pin form and which is inserted in a corresponding end, in socket form, of the center conductor of a co-axial insertion-type connector in the form of a co-axial coupler. When so inserted, the outer conductor of the co-axial plug makes contact with the outer conductor of the co-axial coupler in both the axial and the radial directions in that the tubular end of the outer conductor of the co-axial plug is pressed against an annular step which is formed by the inner side of the outer conductor of the co-axial coupler. The axial force required to do this is applied by means of a ring nut which is rotatably mounted on one of the insertion-type connectors and which is screwed onto an external thread provided on the other, corresponding, insertion-type connector. This screwed connection at the same time serves to secure the co-axial insertion-type connection against coming loose in an unwanted way. A co-axial insertion-type connector of this kind is known from, for example, DE 43 00 243 C1.

To keep intermodulation in the region of the co-axial insertion-type connection as low as possible, extremely low signal to noise ratios are laid down for some of these connections and these can only be achieved by pressing the two co-axial insertion-type connectors making up a co-axial insertion-type connection against one another under very high axial forces. When base stations of mobile telephone networks are being wired up for example, it is necessary for the ring nut of a co-axial insertion-type connection of this kind to be tightened to a torque of up to 35 N-m to achieve the signal to noise ratio called for. The only way of ensuring that a co-axial insertion-type connection of this kind can be reliably assembled in this way is therefore by the use of a torque spanner of a sufficiently large size, which involves not inconsiderable effort and expense.

Also, there are known from U.S. Pat. No. 6,837,754 B1 adapters by which a plurality of cables can be connected, as a group, to a terminal stud of a transformer. Each such connection comprises an annular coupling body against which an annular coupling body belonging to the associated adapter is clamped to make the connection. The surfaces for contact of the coupling bodies are provided with projections and depressions in which corresponding depressions and projections on the mating member respectively engage. The intention is thereby to make the area of contact between the two contacting bodies as large as possible.

SUMMARY OF THE INVENTION

Taking the above prior art as a point of departure, the object underlying the invention is to specify an improved co-axial insertion-type connector and a corresponding co-axial insertion-type connection formed by two co-axial insertion-type connectors of this kind. The particular aim is for the co-axial insertion-type connection according to the invention to be distinguished by its low intermodulation, intermodulation which is also achieved by exerting only low axial forces to connect the two co-axial insertion-type connectors.

This object is achieved by virtue of the subject matter of the description provided herein, as well as the independent claims. Advantageous embodiments of the co-axial insertion-type connector according to the invention and of the co-axial insertion-type connection according to the invention form the subject matter of the respective claims and can be seen from the following description of the invention.

The above and other objects, which will be apparent to those skilled in the art, are achieved in the present invention which is directed to a co-axial insertion-type connector including an outer conductor, a center conductor and an insulator which connects the outer conductor and center conductor, the outer conductor having an axial surface for contact for electrically conductive contact with another co-axial insertion-type connector, such that the axial surface for contact of the outer conductor is provided with one or more projections. The axial surface for contact may include projections which taper to a point, and the projections may be of an undulating form. The projections may further be arranged at the same pitch.

The outer conductor or an outer shell surrounding the outer conductor may include an external thread or a ring nut for connection to another, corresponding, co-axial insertion-type connector.

The co-axial insertion-type connector is preferably adapted to be compatible with DIN 47 223.

In a second aspect, the present invention is directed to co-axial insertion-type connection having a co-axial insertion-type connector in the form of a co-axial plug and a co-axial insertion-type connector in the form of a co-axial coupler, at least one of the co-axial insertion-type connectors being designed to include an outer conductor, a center conductor and an insulator which connects the outer conductor and center conductor, the outer conductor having an axial surface for contact for electrically conductive contact with another co-axial insertion-type connector, such that the axial surface for contact of the outer conductor is provided with one or more projections.

The outer conductor of the co-axial coupler or an outer shell of the latter which surrounds the outer conductor has an external thread and the co-axial plug preferably has a ring nut which can be screwed onto the external thread.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
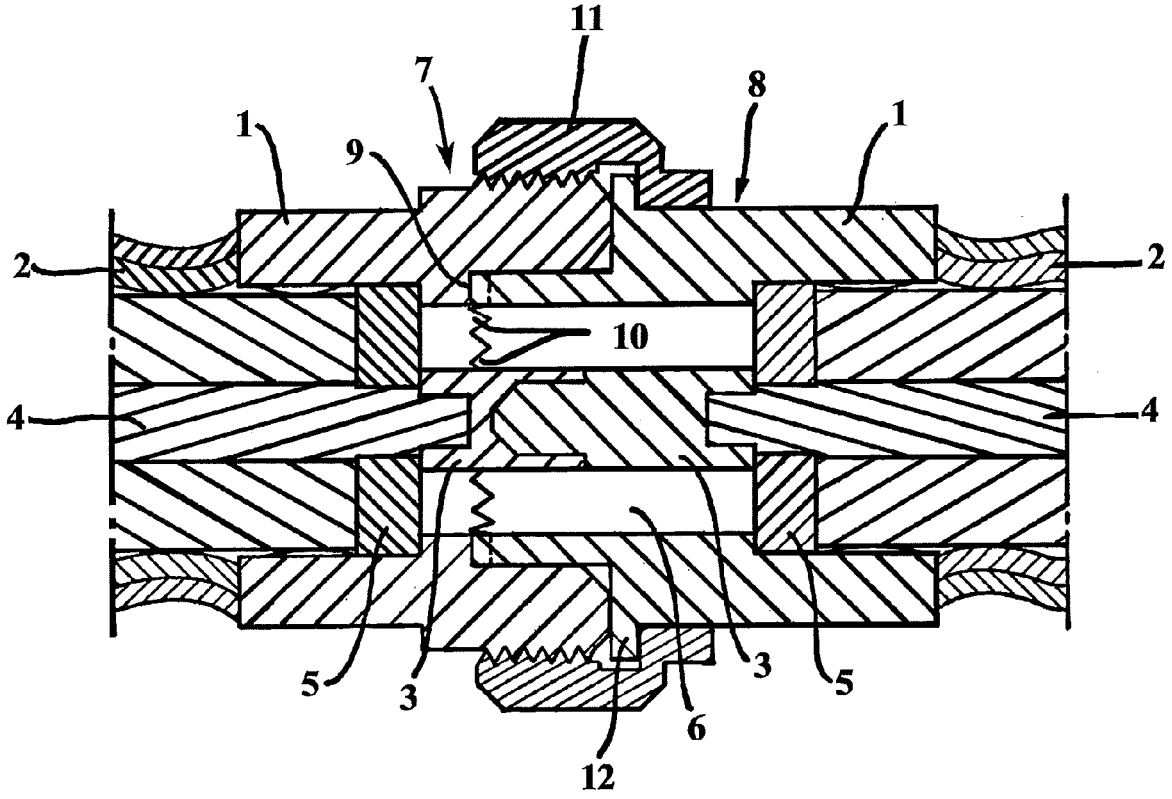
FIG. 1 is a longitudinal section through a first embodiment of co-axial insertion-type connection according to the invention.

In describing the preferred embodiment of the present invention, reference will be made herein to FIGS. 1-3 of the drawings in which like numerals refer to like features of the invention.

The idea underlying the invention is for the making of electrical contact between two conductors which are pressed against one another, and in particular two outer conductors of co-axial insertion-type connectors of the generic kind, to be improved by causing the axial surfaces for contact of the connectors no longer to extend in a (single) radial plane but in at least two, and preferably a plurality of, different planes.

A co-axial insertion-type connector according to the invention, which generically has an outer conductor, a center conductor and an insulator connecting the outer and center conductors, the outer conductor having a axial surface for contact for electrically conductive contact with an outer conductor of a second co-axial insertion-type connector, is characterized in that the axial surface for contact of (at least) the outer conductor is provided with one or more projections. This preferred plurality of projections produces defined points of contact between the two co-axial insertion-type connectors which are to be connected at which there is a low signal to noise ratio even when the latter are pressed against one another by only a relatively low axial force. The assembly of the co-axial insertion-type connection, i.e., the connecting of the two co-axial insertion-type connectors, can be considerably simplified in this way.

Each such co-axial insertion-type connection according to the invention has a co-axial insertion-type connector in the form of a co-axial plug and a co-axial insertion-type connector in the faun of a co-axial coupler, with at least one, and preferably both, of the co-axial insertion-type connectors being designed in accordance with the invention.

In a preferred embodiment of co-axial insertion-type connector according to the invention, the axial surface for contact of the outer conductor is provided with projections which taper to a point. As a particular preference, these latter may be of a triangular basic shape (i.e. may have straight sides), thus giving the end-face of the outer conductor a "saw-tooth" outline.

In an alternative embodiment, the axial surface for contact of the outer conductor of the co-axial insertion-type connector according to the invention may for example equally well have projections which are of an undulating form.

The design according to the invention for a co-axial insertion-type connector which has one or more projections which preferably taper to a point or which are undulating has advantages even when connected to a conventional co-axial insertion-type connector whose axial surface for contact of its outer conductor extends in a (single) radial plane. However, what is particularly preferred is for provision to be made for both the co-axial insertion-type connectors to be designed in accordance with the invention, in which case provision may preferably be made for the projections of the two co-axial insertion-type connectors to engage in one another with as much freedom from play as possible, in order to make particularly good electrical contact. For this purpose, the individual projections on the respective axial surfaces for contact of the outer conductors are preferably of the same dimensions and, also as a preference, are arranged to be distributed around the (annular) axial surfaces for contact of the respective outer conductors at the same pitch.

To secure the co-axial insertion-type connection in the axial direction and against twisting and also to allow an adequate axial force to be generated, provision may preferably be made for the outer conductor of the co-axial insertion-type connector according to the invention to have either an external thread or a ring nut to allow it to be screwed to a corresponding second co-axial insertion-type connector (which then has the mating member: a ring nut or an external thread) to make a co-axial insertion-type connection. A first one of the co-axial insertion-type connectors therefore has an outer conductor having an external thread and the corresponding second co-axial insertion-type connector has a ring nut which can be screwed onto the external thread on the first co-axial insertion-type connector.

The design according to the invention for a co-axial insertion-type connector is particularly suitable for improving co-axial insertion-type connectors which in other respects, i.e., particularly with regard to their diametric dimensions, are designed in accordance with DIN 47 223.

Figure 2:
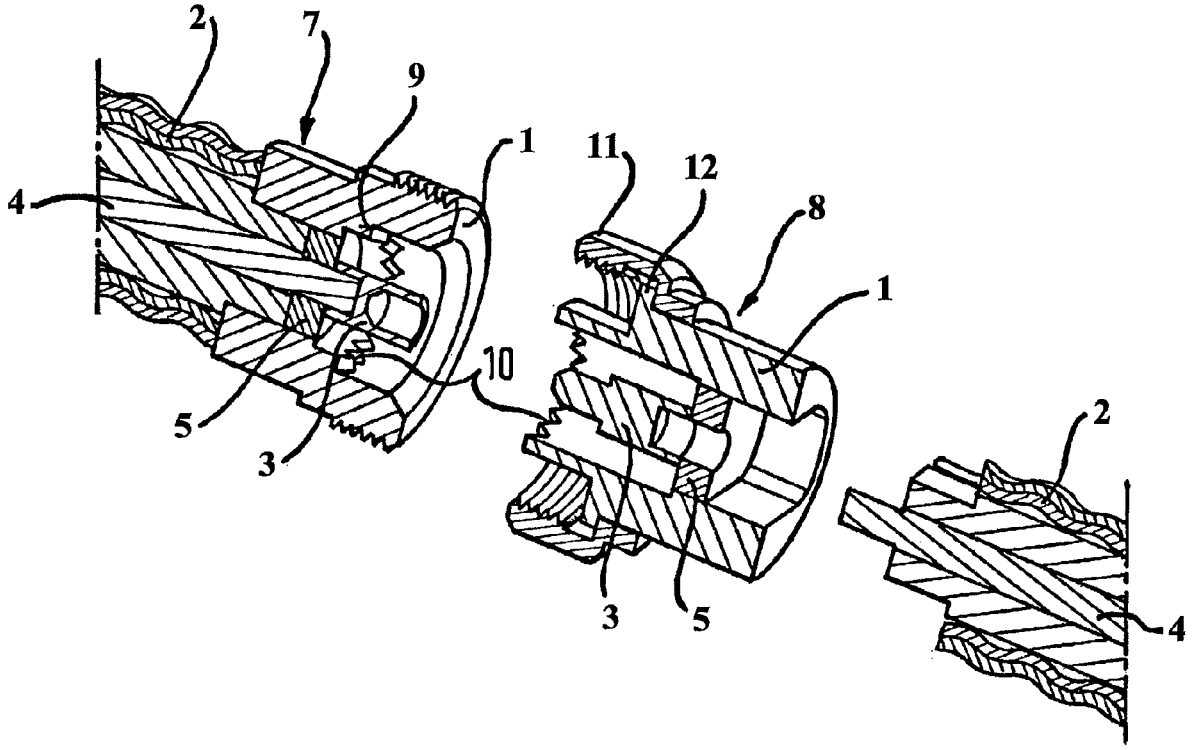
FIG. 2 is an exploded isometric view of the co-axial insertion-type connection shown in FIG. 1.

FIG. 1 shows a first embodiment of co-axial insertion-type connection according to the invention in which two co-axial insertion-type connectors according to the invention are connected together.

Each of the co-axial insertion-type connectors comprises an outer conductor 1 which has an electrically conductive connection to a corresponding outer conductor 2 of a co-axial cable. Each of the co-axial insertion-type connectors also comprises a center conductor 3 which has an electrically conductive connection to a corresponding center conductor 4 of the co-axial cable. The outer conductor 1 and center conductor 3 of each of the co-axial insertion-type connectors are connected together via an insulator 5 in disc form, there being, where the co-axial plug-in connection is in the plugged-together state, an annular space 6 in the region of the insertion ends of the outer conductor 1 and center conductor 3 in which air is provided as a dielectric to insulate the outer conductor 1 and center conductor 3.

The first co-axial insertion-type connector, which is shown on the left-hand side of FIG. 1, takes the form of a co-axial coupler 7, the insertion end of the center conductor 3 taking a bush-like form to receive a corresponding end, in pin form, of the center conductor 3 of the second co-axial insertion-type connector, which takes the form of a co-axial plug 8. Formed on the inside of the outer conductor 1 of the co-axial coupler 7, there is also a radial step 9 which acts as an axial stop in said outer conductor 1 and, at the same time, as an axial surface for contact thereof for the corresponding insertion end of the outer conductor 1 of the co-axial plug 8.

The axial surfaces for contact of the outer conductors 1 of the two co-axial insertion-type connectors shown in FIG. 1 are, in accordance with the invention, of a saw-tooth form, i.e., they form a plurality of identical projections 10 which are arranged at the same pitch and taper to a point and which engage between projections 10 just like them from the surface for contact of whichever is the other outer conductor 1.

To connect the two co-axial insertion-type connectors securely, the co-axial plug 8 is provided with a ring nut 11 whose internal thread engages on a corresponding external thread on the co-axial coupler, the two co-axial insertion-type connectors being pressed against one another axially by screwing the two threaded parts together. When they are so pressed, the ring nut 11, which is rotatably mounted on the outer conductor 1 of the co-axial plug 8, is supported against a radial projection 12 on the outer conductor 1 of the co-axial plug 8.

Figure 3:
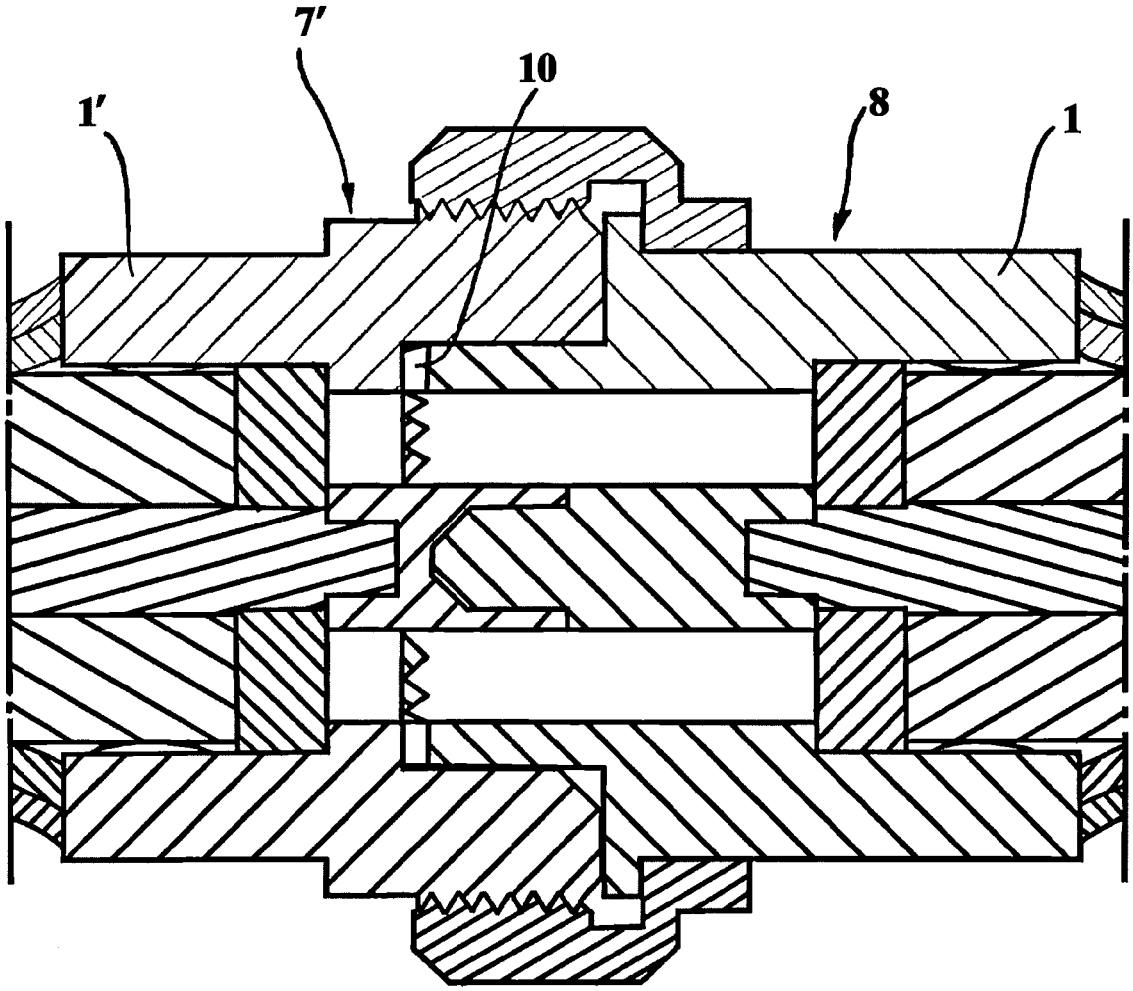
FIG. 3 is a longitudinal section through a second embodiment of co-axial insertion-type connection according to the invention.

The embodiment of co-axial insertion-type connector according to the invention which is shown in FIG. 3 differs from that shown in FIG. 1 merely in that it is only the co-axial plug 8 which is shown on the right-hand side which is designed in accordance with the invention to have saw-tooth projections 10 on the axial surface for contact of the outer conductor 1. The corresponding axial surface for contact of the outer conductor 1' of the co-axial coupler 7' on the other hand is designed in accordance with the prior art, i.e., it lies in a (single) radial plane.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A co-axial insertion-type connector including an outer conductor, a center conductor and an insulator which connects the outer conductor and center conductor, the outer conductor having an axial surface for contacting electrically conductive contact of another co-axial insertion-type connector, such that the axial surface is provided with one or more projections and is of a saw-tooth form, said co-axial insertion-type connector being compatible with DIN 42 733, and wherein the outer conductor and center conductor are connected together, there being, where the co-axial plug-in connection is in the plugged-together state, an annular space in the region of insertion ends of the outer conductor and center conductor in which air is provided as a dielectric to insulate the outer conductor and center conductor.

2. The co-axial insertion-type connector of claim 1, wherein the outer conductor or an outer shell surrounding the outer conductor includes an external thread or a ring nut for connection to another, corresponding, co-axial insertion-type connector.

3. The co-axial insertion-type connector of claim 1, wherein the projections are of the same dimensions and are arranged to be distributed around the axial surface for contact of respective outer conductors at the same pitch.

4. The co-axial insertion-type connector of claim 1, wherein the projections are arranged at the same pitch.

5. The co-axial insertion-type connector of claim 4, wherein the outer conductor or an outer shell surrounding the outer conductor includes an external thread or a ring nut for connection to another, corresponding, co-axial insertion-type connector.

6. A co-axial insertion-type connection having a co-axial insertion-type connector in the form of a co-axial plug and a co-axial insertion-type connector in the form of a co-axial coupler, at least one of the co-axial insertion-type connectors including an outer conductor, a center conductor, and an insulator which connects the outer conductor and center conductor, the outer conductor having an axial surface for contacting electrically conductive contact of another co-axial insertion-type connector, such that the axial surface is provided with one or more projections, said co-axial insertion-type connector being compatible with DIN 42 733, and wherein the outer conductor and center conductor are connected together, there being, where the co-axial plug-in connection is in the plugged-together state, an annular space in the region of insertion ends of the outer conductor and center conductor in which air is provided as a dielectric to insulate the outer conductor and center conductor.

7. The co-axial insertion-type connection according to claim 6, wherein the outer conductor of the co-axial coupler or an outer shell which surrounds the outer conductor has an external thread, and the co-axial plug has a ring nut, which can be screwed onto the external thread.

8. The co-axial insertion-type connector of claim 6, wherein the projections are of the same dimensions and are arranged to be distributed around the axial surface for contact of respective outer conductors at the same pitch.

9. A co-axial insertion-type connector including an outer conductor, a center conductor and an insulator which connects the outer conductor and center conductor, the outer conductor having an axial surface for contact for electrically conductive contact with another co-axial insertion-type connector, such that the axial surface for contact of the outer conductor is provided with one or more projections and is of a saw-tooth form, said outer conductor or an outer shell surrounding the outer conductor includes an external thread or a ring nut for connection to another, corresponding, co-axial insertion-type connector, and wherein the axial surface for contact is provided with projections of an undulating form and includes projections which taper to a point, said projections being arranged at the same pitch; said co-axial insertion-type connector adapted to be compatible with DIN 42 733.

10. The co-axial insertion-type connector of claim 9, wherein the projections are arranged at the same pitch.

11. The co-axial insertion-type connector of claim 9, wherein the outer conductor or an outer shell surrounding the outer conductor includes an external thread or a ring nut for connection to another, corresponding, co-axial insertion-type connector.

12. The co-axial insertion-type connector of claim 9 wherein said co-axial insertion-type connector forming electrically conductive contact with another co-axial insertion-type connector achieves low intermodulation by exerting low axial forces to connect the two co-axial insertion-type connectors.

* * * * *